US005722855A

United States Patent [19]

Kanda et al.

[11] Patent Number: 5,722,855

[45] Date of Patent: Mar. 3, 1998

[54] CONNECTOR AND ITS PARTS

[75] Inventors: Takayoshi Kanda; Nobuyoshi Matsuda; Hiromi Okuzono; Takumi Yamamoto, all of Hyogo-ken; Akio Kusui, Saitama-ken, all of Japan

[73] Assignee: Mitsubishi Cable Industries, Ltd., Hyogo-ken, Japan

[21] Appl. No.: 494,994

[22] Filed: Jun. 27, 1995

[30] Foreign Application Priority Data

| | | | |
|---|---|---|---|
| Jun. 28, 1994 | [JP] | Japan | 6-146333 |
| Aug. 29, 1994 | [JP] | Japan | 6-203280 |

[51] Int. Cl.[6] ..... H01R 9/05

[52] U.S. Cl. ..... 439/578; 439/585; 439/429

[58] Field of Search ..... 439/578, 585, 439/429, 584

[56] References Cited

U.S. PATENT DOCUMENTS

| | | | |
|---|---|---|---|
| 1,871,397 | 8/1932 | Watts | 439/578 |
| 3,474,391 | 10/1969 | Gartzke et al. | 439/584 |
| 4,046,451 | 9/1977 | Juds et al. | 439/429 |
| 4,374,606 | 2/1983 | Lathrop | 439/585 |
| 4,737,601 | 4/1988 | Gartzke | 439/578 |
| 5,217,391 | 6/1993 | Fisher, Jr. | 439/578 |
| 5,518,420 | 5/1996 | Pitschi | 439/578 |

FOREIGN PATENT DOCUMENTS

| | | | |
|---|---|---|---|
| 4309775 | 9/1994 | Germany | 439/584 |
| 1-13334 | 4/1989 | Japan . | |
| 1-15083 | 5/1989 | Japan . | |

*Primary Examiner*—Gary F. Paumen
*Assistant Examiner*—Tho Dac Ta
*Attorney, Agent, or Firm*—Birch, Stewart, Kolasch and Birch, LLP

[57] ABSTRACT

In a connector having first and second connecting cylinders and a split clamp, the first cylinder has a pressing portion projecting inwardly radially from the inside of one end thereof and an annular portion extending axially forwardly from one end thereof. The second cylinder has a conductive pressed portion opposing the pressing portion when connected to the first cylinder. The clamp is sandwiched between the pressing and pressed portions and held by the annular portion. When the clamp is pressed by the pressing portion in association with the connection of the cylinders, it clamps one end of an outer conductor of a coaxial cable in cooperation with the pressed portion.

20 Claims, 6 Drawing Sheets

BACKGROUND ART

BACKGROUND ART

CONNECTOR AND ITS PARTS

BACKGROUND OF THE INVENTION

1. Field of the Invention

The present invention relates to a connector and parts used therefor and more particularly to such kind of connector that is suitable for mounting on a cable like a coaxial cable provided with an outer conductor and parts used therefor.

2. Description of Related Art

As shown in FIG. 6, a conventional connector 50 disclosed in Japanese Utility Model Application S59-17386 (laid open to the public on Aug. 29, 1985) and Japanese Utility Model Application No. S59-166251 (laid open to the public on May 29, 1986) comprises connecting cylinders 51 and 52, a split clamp 53, a support 54, a contact 57 and an insulator 58. A coaxial cable 100 attached to the connector 50 comprises an outer conductor 101 formed of an annularly corrugated conductor tube, an inner conductor 102 formed of a conductor tube, and an insulator 103.

Within the connecting cylinder 51 there is fitted a connecting end 100*a* of the coaxial cable 100. The connecting cylinders 51 and 52 are provided with flanges 51*a* and 52*a*, respectively. Between the connecting cylinders 51 and 52 there are arranged a split clamp 53 and a support 54. As shown in FIG. 7, the split clamp 53 comprises a pair of semicircular split members 53*a*, 53*a* whose one-side ends are connected to each other by means of a nylon belt 55 and screws 56.

Returning to FIG. 6, on the internal surface (the right side) of the support 54 there is provided a receiving seat 54*a* and the split clamp 53 is fitted in the receiving seat 54*a* with an end surface thereof facing the inner surface of the support 54. The outer conductor 101 is annularly corrugated and a connecting end 101*a* thereof is expanded radially outwardly after it is passed through the connecting cylinder 51 and clamped between the end surface of the split clamp 53 and the receiving seat 54*a* of the support 54.

Thus, the coaxial cable 100 is mechanically fixed to the connector 50 in such a manner that the flanges 51*a* and 52*a* of the connecting cylinders 51 and 52 are connected together by means of screws (not shown) while the end 101*a* of the outer conductor 701 is clamped between the split clamp 53 and the support 54. As a result, the end 101*a* of the outer conductor 101 is electrically connected to the connecting cylinder 52 through the support 54.

The contact 57 of the connector 50 is supported on the inner surface (the left side) of the support 54 through the insulator 58 which is splitted into two circular arc-shaped parts. The left-side inner surface of the support 54 is provided with a receiving seat 54*b* for supporting the insulator 58 which in turn supports the contact 57 by being fitted in the inner surface of the support 54 while sandwiching the contact 57.

The contact 57 has a male screw-threaded portion 57*a* on the outer peripheral surface of its end on the side of the coaxial cable so that the male screw-threaded portion 57*a* is brought into engagement with a female screw-threaded portion 102*a* formed on the inner peripheral surface of the inner conductor 102 of the coaxial cable 100 allowing the contact 57 to be mechanically and electrically fixed to the inner conductor 102.

To describe the manner of assembling the conventional connector 50 of the above-described structure, the coaxial cable 100 is fitted in advance into the connecting cylinder 51 from one of its openings. Then the connecting end 101*a* of the outer conductor 101 of the coaxial cable 100 led out from the other opening of the connecting cylinder 51 is held expanded outwardly and the inner peripheral surface of the connecting end 102*a* of the inner conductor 102 of the coaxial cable 100 is tapped to form the male screw-threaded portion 102*a*. After that, the split clamp 53 is fixed to the outer peripheral surface of the connecting end 101*a* of the outer conductor 101 of the coaxial cable 100 and the connecting end 101*a* of the outer conductor 101 is clamped between the end surface of the split clamp 53 and the rightside inner surface of the support 54 having the receiving seat 54*a*.

The contact 57 is fixedly connected to the inner conductor 102 of the coaxial cable 100 by mounting the insulator 58 and bringing the male screw-threaded portion 57*a* of the contact 57 into engagement with the female screw-threaded portion 102*a* of the inner conductor 102. In this case, the insulator 58 is supported by the receiving seat 54*b* on the other inner surface of the support 54. Thus, after the contact 57 has been connected, the flange 52*a* of the connecting cylinder 52 is made to face to face with the flange 51*a* of the connecting cylinder 51 thereby connecting the two connecting cylinders 51 and 52 by means of screws. By the connection of the two connecting cylinders, the connecting end 101*a* of the outer conductor 101 of the coaxial cable 100 is pressed against one of the inner surfaces of the support 54 due to the thrusting force from the split clamp 53 resulting in that the outer conductor 101 of the coaxial cable 100 is electrically connected to the connecting cylinder 52 through the support 54. As a result, an electrical path for establishing an electrical connection between the outer conductor 101 of the coaxial cable 100 on the side of the connecting cylinder 51 and the outer conductor (not shown) of the coaxial cable on the side of the connecting cylinder 52 is formed.

The surface of the connecting cylinder 52 is covered with a silver-plated layer (not shown) for securing the conductivity of the electrical path on the side of the outer conductor 101 of the coaxial cable 100. Further, the silver-plated layer is covered with a nickel-plated layer (not shown) with the exception of the inner peripheral surface serving as the electrical path on the side of the outer conductor 101, for anti-corrosion purposes.

However, in the case of the conventional connector 50, the support 54 is required only for supporting the split clamp 53 and the insulator 58 within the connector assembly so that it is desirable if the support 54 can be omitted in view of reducing the number of connector parts, the cost of the assembling work, the connector manufacturing cost and the weight of the connector. Particularly, since the support 54 is disposed between the two connecting cylinders 51 and 52, the connector 50 is axially elongated and it is desired to omit the support 54 also in view of miniturization of the connector.

Further, the nylon belt 55 used for coupling the split members 53*a* and 53*b* forming the split clamp 53 is expensive and much time and labor are required to connect them.

Moreover, the ridge 57*b* of the male screw-threaded portion 57*a* for fixing the contact 57 to the inner conductor 102 is made triangular as shown in FIG. 8. Consequently, the female screw-threaded portion 102*a* on the inner peripheral surface of the inner conductor 102 mating with the male screw-threaded portion 57*a* becomes triangular in section so that the tapping operation for forming the female screw-threaded portion must be performed several times separately. The reason for this is that since the female screw-threaded portion 102*a* has a triangular clearcut structure, when it has been formed in only one tapping operation, the inner conductor 102 may be easily damaged in operation. To avoid such a damage, it is required to perform the above-described tapping operation several times as above. However, such repetition of tapping operations inevitably elongates the connector assembling time and since several pieces of taps have to be prepared, the assembling cost increases. Further, the triangular clearcut female screw-threaded portion 102*a* weakens the mechanical strength of the inner conductor 102.

It takes much time and labor to form plated layers including a silver-plated layer and a nickel-plated layer on the connecting cylinder 52. The reason for this is that the entire surface of the connecting cylinder 52 is first covered with the silver-plated layer. Next, the nickel-plated layer is formed on the surface of the connecting cylinder 52 by masking a portion of the inner peripheral surface of the connecting cylinder 52 which should not be plated with nickel in view of forming the above-mentioned electrical path. Thus, due to the necessity of the complicated masking step between the two plating steps, the two plating steps can not be performed continuously, which results in needing much time and labor.

SUMMARY OF THE INVENTION

Accordingly, an object of the present invention is to provide a connector which can be constructed by a small number of parts, is of compact structure, can be manufactured at low cost and which can be assembled with ease.

Another object of the present invention is to provide a connector having connecting cylinders which can be plated in a simple manner.

A further object of the present invention is to provide a connector having a clamp of a simplified structure thereby reducing the manufacturing cost thereof.

A still further object of the present invention is to provide a connector with which it is possible to reduce the time and labor required for a contact to have a connecting structure thereby increasing the strength of the contact.

A connector according to a first preferred embodiment of the present invention is able to achieve the above-mentioned objects and comprises a first connecting cylinder, a second connecting cylinder and a split clamp. A coaxial cable having an outer conductor and an inner conductor is inserted in the first connecting cylinder. The first connecting cylinder is provided with a pressing portion projecting inwardly radially from the inside of one end thereof and an annular portion extending axially forwardly from the one end thereof. The second connecting cylinder has a conductive pressed portion opposing said pressing portion of said first connecting cylinder when one end thereof is connected to said one end of said first connecting cylinder.

The split clamp consists of at least two separable split members. The split members are held by the annular portion of the first connecting cylinder between the pressing portion of the first connecting cylinder and the pressed portion of the second connecting cylinder such that one end surface of the split clamp faces the pressing portion of the first connecting cylinder and the other end surface thereof clamps one end of the outer conductor in cooperation with the pressed portion of the second connecting cylinder. The split clamp operates such that the one end surface of the split clamp is pressed by the pressing portion in association with the connection operation of the first and second connecting cylinders and the other end surface thereof brings the one end of the outer conductor into contact with the pressed portion of the second connecting cylinder.

A second preferred embodiment of the present invention is provided with a first connecting cylinder, a second connecting cylinder and a split clamp. The split clamp is sandwiched between the first and second connecting cylinders and presses the outer conductor toward one end of the second connecting cylinder in association with the connection operation of the two connecting cylinders. Further, the split clamp comprises at least two separable split members. One-side ends of the split members are connected to each other by a textile fabric adhesive tape and the other-side ends thereof are left unconnected to each other.

A third preferred embodiment of the present invention has a connecting cylinder electrically connected to one end of an outer conductor of a coaxial cable. The connecting cylinder is provided with a corrosion-proof plated layer covering the entire surface thereof and an electrical path-forming plated layer covering the corrosion-proof plated layer.

A fourth preferred embodiment of the present invention has a contact connected to an inner conductor of a coaxial cable. The contact is provided with a screw-threaded portion trapezoidal in section and fits with the inner conductor.

According to the above-mentioned first preferred embodiment, since the split clamp is held by the annular portion of the first connecting cylinder when assembling the connector, it is not necessary to separately provide any member holding the split clamp.

According to the above-mentioned second preferred embodiment, since the member connecting the split members is made of an inexpensive textile fabric adhesive tape, it is possible to reduce the number of parts and the manufacturing cost of the connector. Further, the connection of the two portions of the split clamp is performed by mere application of the textile fabric adhesive tape so that the connecting operation can be performed with ease.

According to the third preferred embodiment, the plated layers can be formed continuously in a series of plating lines without interposing a masking step.

According to the fourth preferred embodiment, the shape of the screw-threaded portion provided on the inner conductor in correspondence to the trapezoidal screw-threaded portion formed on the contact can be formed shallow. Accordingly, the thickness of the end portion of the inner conductor increases to thereby improve the strength of the conductor. In addition where such a screw-threaded portion is formed on the inner conductor, even if the screw-threaded portion is formed by a single tapping operation, there is no fear of breakage of the inner conductor.

BRIEF DESCRIPTION OF THE DRAWINGS

The accompanying drawings, which are incorporated in and form a part of this specification, illustrate embodiments of the invention and, together with the description serve to explain the principles of the invention. In the drawings.

In all these figures, like components are indicated by the same numerals.

BRIEF DESCRIPTION OF THE INVENTION

The present invention will now be described in detail by referring to the accompanying drawings.

Figure 1:
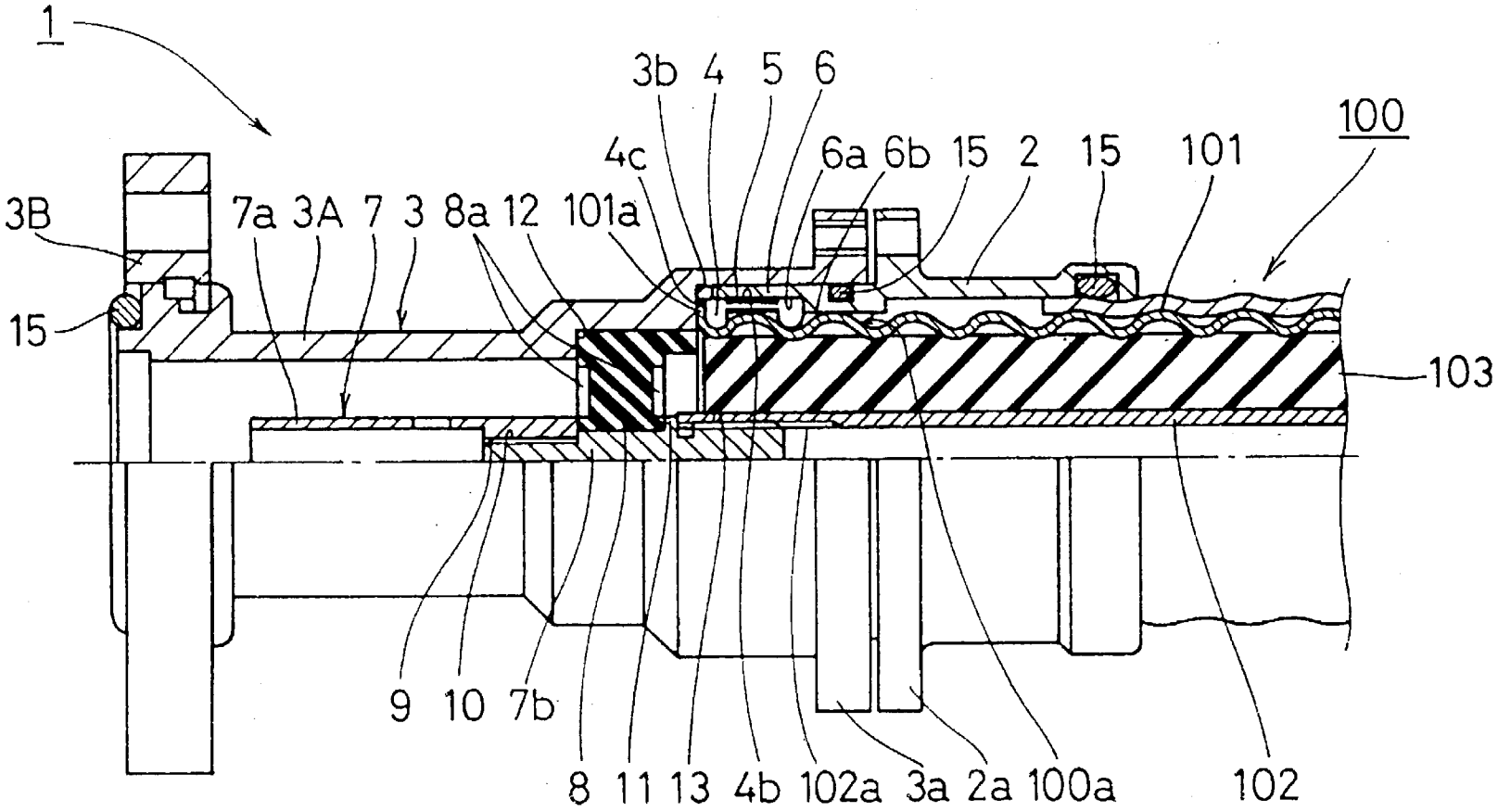
FIG. 1 is a front view (partly cut away) of a connector according to a preferred embodiment of the present invention.
Figure 3:
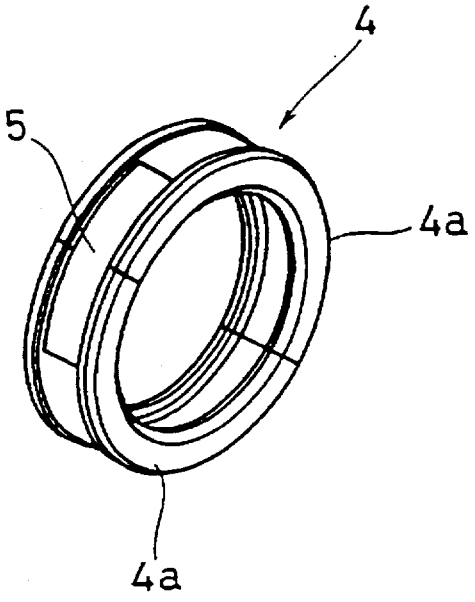
FIG. 3 is a perspective view of a split clamp of the connector shown in FIG. 1.

In FIG. 1, a connector 1 according to a first preferred embodiment of the present invention and which is mounted on a coaxial cable 100 comprises an outer conductor 101 formed of an annularly corrugated conductive tube, inner conductor 102 formed of a conductive tube and an insulator 103. The connector 1 is provided with a first connecting cylinder 2 made of brass and a second connecting cylinder 3. Between the connecting cylinders 2 and 3 there is arranged a split clamp 4. The split clamp 4 is preferably made of brass and the surface thereof is plated with nickel. Further, as shown in FIG. 3, the split clamp 4 has an inner surface coinciding in shape with the outer peripheral surface of the outer conductor 101 and comprises a pair of semi-circular split members 4*a*, 4*a* whose one-side ends are brought to face to face with each other with the remaining ends thereof being connected by means of an inexpensive cotton adhesive tape 5. The connection of the two split members by only the cotton adhesive tape can be performed in a simple manner and at low cost as compared to the conventional method of connection by using a nylon belt and screws.

A connecting end 100*a* of the coaxial cable 100 is interposed between the two connecting cylinders 2 and 3. One end surface 4*c* of the split clamp 4 is in contact with a connecting end 101*a* of an outer conductor 101 which is outwardly expanded in advance.

At one end of the first connecting cylinder 2 located on the side of the connecting end 100*a* of the coaxial cable 100 there is provided an annular portion 6. The annular portion 6 is coaxially and integrally formed with the first connecting cylinder 2 so as to project toward the second connecting cylinder 3. An inner peripheral surface 6*a* of the annular portion 6 has the same diameter as the outer peripheral surface 4*b* of the split clamp 4. The split clamp 4 fitted about one end of the outer conductor 101 is fitted into the annular portion 6 so as to be supported by the latter. The axial length of the annular portion 6 is somewhat shorter than the axial length of the split clamp 4 and in the innermost portion of the annular portion 6 there is provided a step 6*b* which forms itself a pressing portion to stop the split clamp 4. Accordingly, the split clamp 4 is stopped by the step 6*b* and supported by the annular portion 6 with the top end of the clamp 4 somewhat projecting from the annular portion 6. Further, the annular portion 6 has an outer peripheral surface identical in shape to that of the first connecting cylinder 2.

On the inner peripheral surface of the end of the second connecting cylinder 3 on the side of the first connecting cylinder 2 there is formed a receiving seat 3*b* having a shape coinciding with the outer peripheral surfaces of the first connecting cylinder 2 and the annular portion 6. When both of the connecting cylinders 2 and 3 are connected, the split clamp 4 is received in the receiving seat 3*b* in the state of its being received by the annular portion 6.

The connecting cylinders 2 and 3 are made integral with each other with flanges 2*a* and 3*a* coupled to each other by means of screws (not shown). In this case, the split clamp 4 is pressed toward the second connecting cylinder 3 by the step 6*b* so that the end surface 4*c* of the split clamp 4 is pressed against the bottom surface of the receiving seat 3*b* which is a pressed portion and the end 101*a* of the outwardly expanded outer conductor 101 is brought into pressure-contact with the bottom surface of the receiving seat 3*b*. Consequently, the outer conductor 101 is connected to the connector 1 and electrically connected to the second connecting cylinder 3.

Thus, in the connector 1, the outer conductor 101 and the second connecting cylinder 3 are directly connected to each other by bringing the outer conductor 101 into direct pressure contact with the second connecting cylinder 3 so that no member for assisting electrical connection between the two exists thereby securing the connection of the outer conductor 101 and the second connecting cylinder 3.

Figure 2:
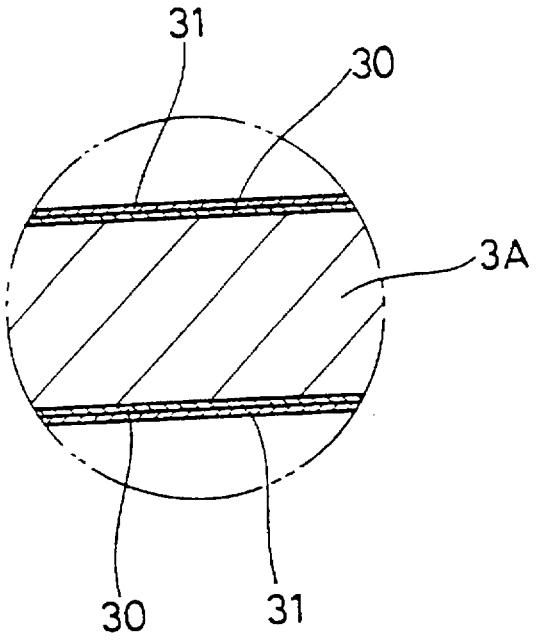
FIG. 2 is an enlarged sectional view of a second connecting cylinder of the connector shown in FIG. 1.

The second connecting cylinder 3 comprises a base cylinder 3A and a flange 3B. The flange 3B is rotatably fixed to the outer periphery of one end of the base cylinder 3A. As shown in FIG. 2, the entire surface of the base cylinder 3A is covered with a corrosion-proof nickel-plated layer 30 which is further covered with an electrical path-forming silver-plated layer 31. Since the second connecting cylinder 3 is covered with the corrosion-proof plated layer 30, the corrosion-proof property of the base cylinder 3A is secured. Further, since the electrical path forming plated layer 31 is formed as an outermost layer, the conductivity of the electrical path on the side of the outer conductor 101 is fully secured.

In forming the plated layers 30 and 31, first the base cylinder 3A is immersed in a nickel plating tank (not shown) to thereby form the corrosion-proof plated layer 30 of nickel over the entire surface of the base cylinder 3A. Then, the base cylinder 3A covered with the corrosion-proof plated layer 30 is immersed in a silver plating tank (not shown) to thereby form the electrical path-forming plated layer 31 of silver over the entire surface of the corrosion-proof plated layer 30. Thus, since the plated layers 30 and 31 are formed continuously in a series of plating lines without interposing a separate masking step, it is possible to perform an advantageous simple plating operation thereby contributing to the reduction of the manufacturing cost.

The first connecting cylinder 2 has no direct relation with the electrical connection between the first connecting cylinder 2 and the outer conductor 101 so that the surface of the connecting cylinder 2 is covered with the nickel-plated corrosion-proof layer as in the case of the connecting cylinder 3 but it is not covered with the electrical path-forming silver-plated layer.

At the same time, within the connector 1, there is fixedly supported a contact 7 through an insulator 8. The contact 7 is provided with a pair of contact members 7*a* and 7*b* which are separated from each other in the axial direction. These contact members 7*a* and 7*b* are connected to each other in such a manner that a male screw-threaded portion 10 at the end of the contact member 7*b* is screw-fitted with a female screw-threaded hole 9 at the end of the contact member 7*a*. Further, the contact members 7*a* and 7*b* are preferably made of brass covered with an electrical path-forming silver-plated layer. It is preferable that the insulator 8 be made of polyethylene in the shape of a ring. This insulator 8 is fitted about the contact member 7*b*. When the contact member 7*b* is connected to the contact member 7*a*, the insulator 8 is held between the end of the contact member 7*a* and a flange 11 of the contact member 7*b* to become integral with the contact 7.

On the inner surface of the second connecting cylinder 3 there is formed a receiving seat 12 for supporting the insulator 8. The receiving seat 12 opens on the side of the first connecting cylinder 2. By the fitting of the insulator 8 into the receiving seat 12 while the insulator is made integral with the contact 7, the contact 7 is fixedly supported within the second connecting cylinder 3. On the end surfaces of the insulator 8 along the radial direction of the second connecting cylinder 3 there are formed characteristic impedance-adjusting dents 8*a* along the peripheral surface thereof.

Figure 4:
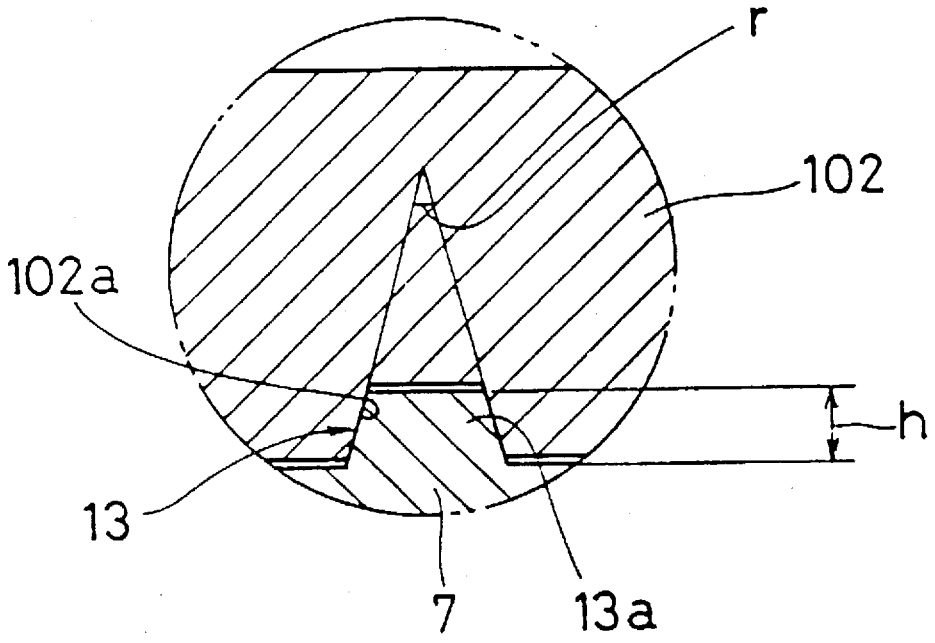
FIG. 4 is an enlarged sectional view of an essential portion of a contact of the connector shown in FIG. 1.

The contact 7 is provided with a male screw-threaded portion 13 on the outer peripheral surface of the end thereof on the side of the coaxial cable. As shown in FIG. 4, the male screw-threaded portion 13 is provided with ridges 13*a* which are trapezoidal in section and the contact 7 is fixedly connected with the inner conductor 102 when the male screw-threaded portion 13 is screw-fitted with the female screw-threaded portion 102*a* formed on the inner peripheral surface of the inner conductor 102.

The coaxial cable 400 has an insulator 103 between the outer conductor 101 and the inner conductor 102, and the connector 1 is provided with O-rings 15 at positions where the first and second connecting cylinders 2 and 3 are connected together.

Next, the assembling of the connector 1 according to the first preferred embodiment of the present invention will be described. The end 101*a* of the outer conductor 101 is expanded outwardly in advance while the first connecting cylinder 2 is fitted about the coaxial cable 400. At the same time, the inner peripheral surface of the connecting end of the inner conductor 102 is tapped to form the female screw-threaded portion 102*a*. Since the ridges 13*a* of the male screw-threaded portion 13 mating with the female screw-threaded portion 102*a* are trapezoidal in section, the depth of the screw-threaded portion 13 is not large and therefore, a single tapping operation is sufficient for the formation of the female screw-threaded portion 102*a* thereby simplifying the operation.

In the above condition, the split clamp 4 is fitted about the outer conductor 101 at a position near the connecting end 101*a*. Then the first connecting cylinder 2 is moved toward the end 101*a* of the outer conductor 101 whereby the split clamp 4 is received within the annular portion 6 in such a manner that the split clamp 4 is fitted about the outer conductor 101 while it is stably supported by the annular portion 6 thereby preventing the slipping out of the split clamp 4 from the outer conductor 101.

Further, the contact 7 is fixedly connected to the inner conductor 102 by screw-fitting the male screw-threaded portion 13 of the contact 7 having the insulator 8 mounted thereon with the female screw-threaded portion 102*a* of the inner conductor 102. In this case, the insulator 8 is held supported by and between the contact members 7*a* and 7*b*. Consequently, during the fitting operation for the contact 7, the insulator 8 is prevented from slipping out of the contact 7 to thereby facilitate the operation.

Upon completion of the fixing operation for the contact 7, the receiving seat 3*b* of the second connecting cylinder 3 is fitted about the first connecting cylinder 2. Then the flange 3*a* of the second connecting cylinder 3 is brought to face to face with the flange 2*a* of the first connecting cylinder 2 and both of the connecting cylinders are integrally fixed together by means of screws (not shown). In this case, the split clamp 4 cannot move as it is stopped by the step 6*b* and as a result, the end surface 4*c* of the split clamp 4 presses the end 101*a* of the outer conductor 101 against the bottom surface of the receiving seat 3*b*. Accordingly, the outer conductor securely connected to the second connecting cylinder mechanically and electrically. Further, by the connection of the connecting cylinders 2 and 3, the insulator 8 is received by the receiving seat 12.

Figure 6:
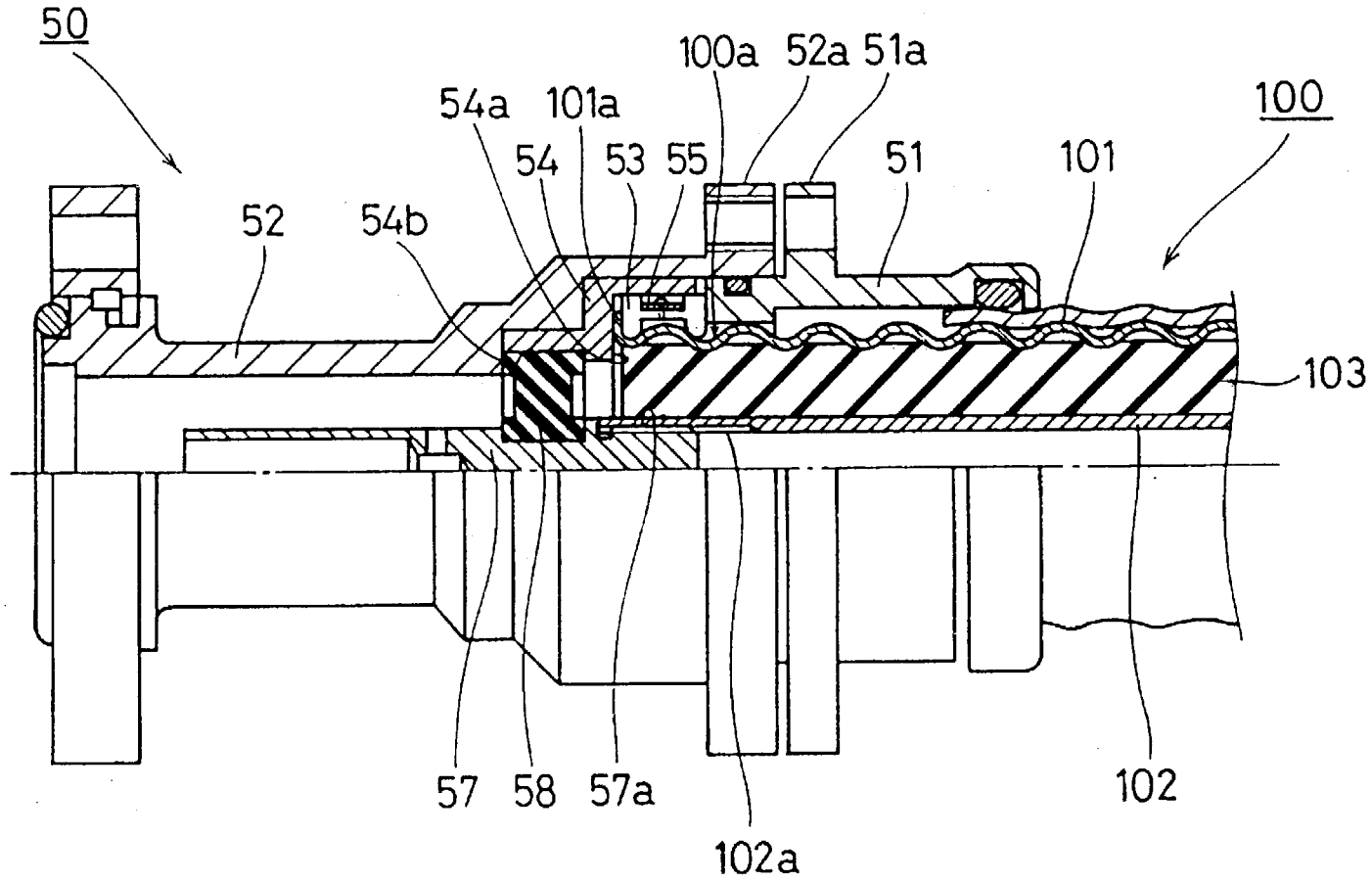
FIG. 6 is a front view (partly cut away) of a conventional connector.
Figure 7:
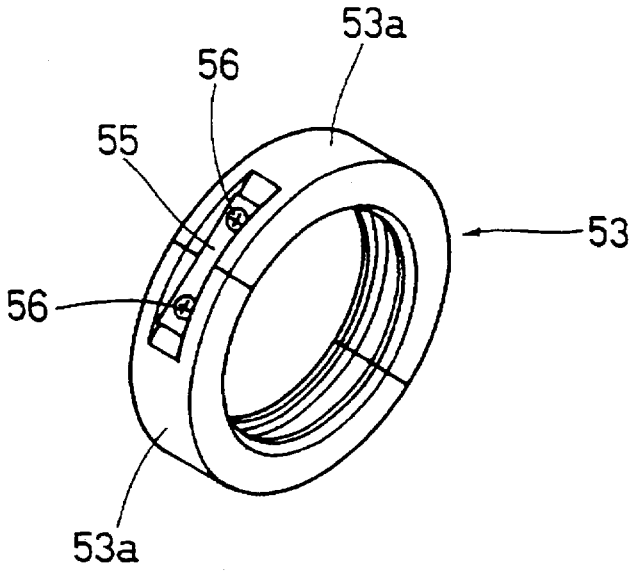
FIG. 7 is a perspective view of a split clamp of the conventional connector.

During the assembling operation, the insulator 8 is held supported by the contact members 7*a* and 7*b* and the split clamp 4 is also retained by the annular portion 6. Therefore, no further member for supporting the insulator 8 and the split clamp 4 is required during the assembling operation. Accordingly, the member which has been incorporated as a support 54 shown in FIG. 6 can be dispensed with, thereby contributing to the reduction of the number of parts and the manufacturing cost. Moreover, since the number of parts to be incorporated can be reduced by one, the axial length of the connector 1 is shortened by that degree to reduce the entire weight of the connector 1.

In the instant embodiment, the male screw-threaded portion 13 of the contact 7 is provided with the trapezoidal ridges 13*a* as shown in FIG. 4. A result of comparison between the strength of connection of such contact 7 and the inner conductor 102 and the strength of connection of the conventional contact having the male screw-threaded portion with triangular ridges and the inner conductor 102 will be described. The measured objects were a brass contact 7 of the instant embodiment provided with M 8.3 trapezoidal ridges 13*a* having a ridge angle r of 30° (refer to FIG. 4) and a conventional brass contact 57 provided with M 8.7 triangular ridges 57*b* having a ridge angle r of 60° of the same pitch (refer to FIG. 8).

The contacts 7, 57 were samely connected to a copper tubelike inner conductor 102 having an outer diameter of 9.6 mm and an inner diameter of 8.0 mm and provided with a female screw-threaded portion 102*a* coinciding with the male screw-threaded portion 13, 57*a*. Then the tensile strength of each of the instant embodiment and the conventional product was measured to find out that the tensile strength of the conventional product was 340 Kgf while that of the instant embodiment was 469 kgf showing a remarkable improvement over the former with respect to the tensile strength.

By the way, it goes without saying that although what was measured was one of the preferred embodiments of the present invention, the same result will be obtained with respect to the other embodiments of the present invention having thread ridges of different pitches.

Figure 8:
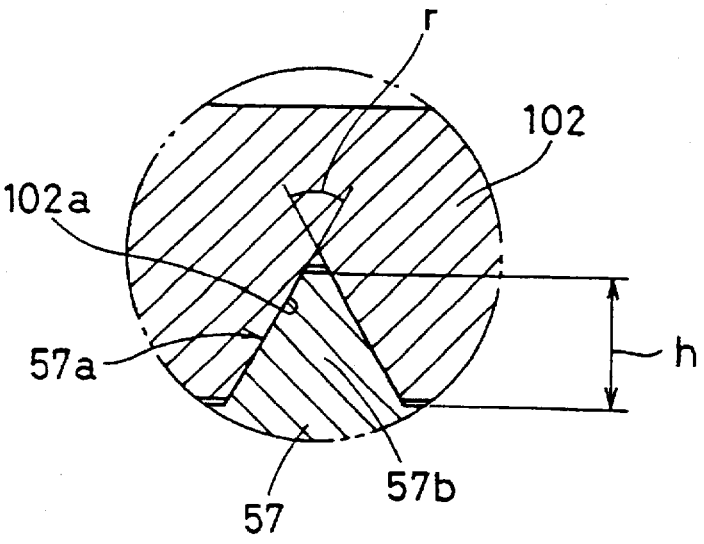
BACKGROUND ART FIG. 8
FIG. 8 is an enlarged sectional view of an essential portion of a contact of the conventional connector.

Further, in the case of the instant embodiment, the height h of the thread ridge 13*a* of the contact 7 shown in FIG. 4 is smaller than that of the conventional one shown in FIG. 8 (for example, the thread ridge of the contact of the instant embodiment is lower than that of the conventional one by 0.2 mm). Therefore, the depth of the height h of the thread ridge 57*b* of 102*a* formed on the inner conductor 102 are made smaller by that degree so that the thickness of the inner conductor at the root portion of the female screw-threaded portion 102*a* can be made large (for example, By 0.2 mm in the case of the instant embodiment shown in FIG. 4) thereby increasing the mechanical strength of the inner conductor 102 accordingly.

Figure 5:
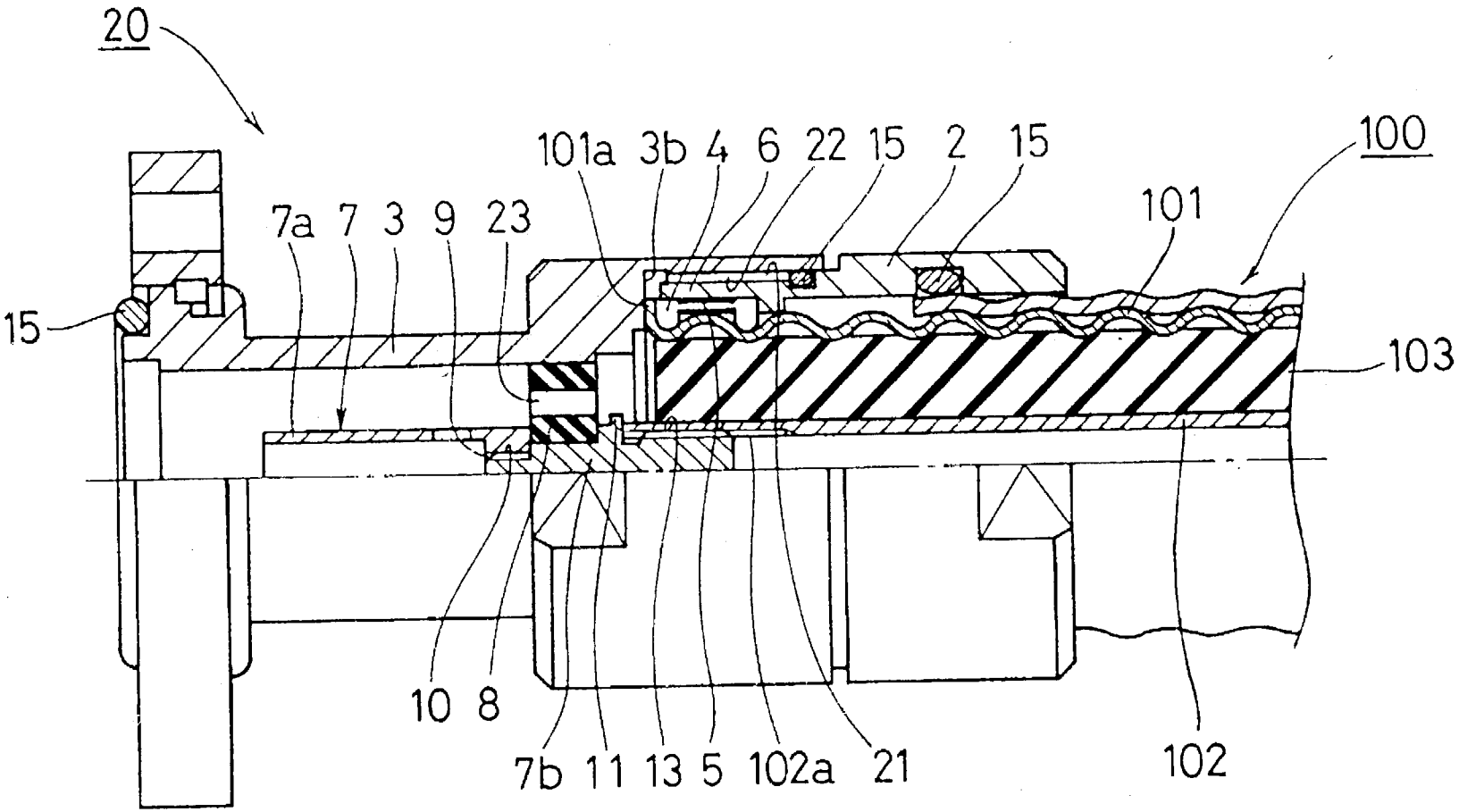
FIG. 5 is a front view (partly cut away) of a connector according to another preferred embodiment of the present invention.

Next, a second preferred embodiment of the present invention will be described by referring to FIG. 5. Basically, a connector 20 has the same structure as the connector 1 of the first embodiment of the present invention wherein like parts are designated by like reference numerals and detailed descriptions of these parts are omitted.

The connector 20 is characterized by the connecting structure of a first and a second connecting cylinders 2 and 3. That is, the first connecting cylinder 2 is provided with a male screw-threaded portion 21 extending over the outer peripheral surface thereon on the side of the second connecting cylinder 3 and the outer peripheral surface of the annular portion 6. On the other hand, on the side wall surface of the receiving seat 3 of the second connecting cylinder 3 there is formed a female screw-threaded portion 22 corresponding to the male screw-threaded portion 21. Thus, by screw-fitting the female screw-threaded portion 22 with the male screw-threaded portion 21, the second connecting cylinder 3 is connected to the first connecting cylinder 2. By the connection of the connecting cylinders 2 and 3, the connecting end 101*a* of the outer conductor 101 is held clamped by the split clamp 4 and the bottom surface of the receiving seat 3*b*. As a result, the outer conductor 101 is mechanically and electrically connected to the second connecting cylinder 3 and although not shown in FIG. 5, there is formed on the surface of the second connecting cylinder 3 the corrosion-proof plated layer 30 and the electrical path-forming plated layer 31 shown in FIG. 2.

Further, in the case of the above connector 20, the insulator 8 is fixedly supported within the second connecting cylinder 3 by coming into contact with the inner peripheral surface of the second connecting cylinder 3. The insulator 8 is provided with a characteristic impedance-adjusting through-hole 23.

In summary, all such modifications and variations that may be apparent to a person skilled in the art are intended to be within the scope of this invention.

What is claimed is:

1. A connector comprising:

a first connecting cylinder for insertion of a coaxial cable therein having an outer conductor and an inner conductor, said first connecting cylinder having a pressing portion projecting radially inwardly from the inside of one end thereof, and an annular portion extending axially forwardly from said one end thereof;

a second connecting cylinder having a conductive pressed portion opposing said pressing portion of said first connecting cylinder when one end thereof is connected to said one end of said first connecting cylinder; and a split clamp including at least two separable split members, said split clamp being longer axially than said annular portion of said first connecting cylinder and held by said annular portion of said first connecting cylinder between said pressing portion of said first connecting cylinder and said conductive pressed portion of said second connecting cylinder such that one end surface of said split clamp faces the pressing portion of said first connecting cylinder and the other end surface thereof clamps one end of said outer conductor against said conductive pressed portion of said second connecting cylinder when said first connecting cylinder is connected to said second connecting cylinder, said split clamp operating such that said one end surface of the split clamp is pressed by said pressing portion in association with the connection operation of said first and second connecting cylinders, and the other end surface thereof brings said one end of said outer conductor into contact with said pressed portion of said second connecting cylinder.

2. The connector according to claim 1, wherein said outer conductor of said coaxial cable is in the shape of an annularly corrugated conductor and said split clamp has an inner peripheral surface coinciding in shape with the outer peripheral surface of said outer conductor.

3. The connector according to claim 1, wherein said first and second connecting cylinders are connected to each other by flanges.

4. The connector according to claim 1, wherein each of said first and second connecting cylinders includes a screw-thread portion for matingly engaging with one another to interconnect said first and second connecting cylinders together.

5. The connector according to claim 1, wherein said split members are connected to each other by means of a textile fabric adhesive tape.

6. The connector according to claim 5, wherein said textile fabric adhesive tape is a cotton adhesive tape.

7. The connector according to claim 1, wherein said second connecting cylinder includes a corrosion-proof plated layer covering the entire surface thereof and an electrically path-forming plated layer covering the entire surface of said corrosion-proof plated layer.

8. The connector according to claim 7, wherein said corrosion-proof plated layer is a nickel-plated layer and said electrical path-forming plated layer is a silver-plated layer.

9. The connector according to claim 1, further comprising a contact connected to said inner conductor of said coaxial cable and an insulator supporting said contact within said second connecting cylinder, said contact having a pair of flanges for holding said insulator.

10. The connector according to claim 9, wherein said insulator has impedance-adjusting dents on the end surfaces thereof along the radial direction of said inner conductor of said coaxial cable.

11. The connector according to claim 9, wherein said insulator is annular, and a radially outermost surface of said insulator contacts a radially inwardly directed surface of said second connecting cylinder when said first connecting cylinder is connected with said second connecting cylinder.

12. The connector according to claim 9, wherein said insulator is annular having a first thickness at a radially innermost portion thereof and a second thickness larger than said first thickness at a radially outermost portion thereof.

13. The connector according to claim 9, wherein a portion of said insulator is located directly adjacent to said one end of said outer conductor.

14. The connector according to claim 9, wherein a portion of said insulator is in radial alignment with said conductive pressed portion of said second connecting cylinder.

15. The connector according to claim 9, wherein said contact has a screw-threaded portion capable of screw-fitting with said inner conductor of said coaxial cable, said screw-threaded portion being trapezoidal in section.

16. The connector according to claim 15, wherein said screw-threaded portion is a male screw.

17. The connector according to claim 1, wherein said first connecting cylinder includes a corrosion-proof plated layer covering the entire surface thereof.

18. The connector according to claim 17, wherein said corrosion-proof plated layer is a nickel plated layer.

19. The connector accordinq to claim 1, further comprising a contact connected to said inner conductor of said coaxial cable, wherein said contact is provided with a screw-threaded portion which is trapezoidal in section and which fits with said inner conductor.

20. The connector according to claim 19, wherein said screw-threaded portion is a male screw.

* * * * *